US009683511B2

(12) United States Patent
Ulrey et al.

(10) Patent No.: US 9,683,511 B2
(45) Date of Patent: Jun. 20, 2017

(54) METHOD AND SYSTEM FOR SUPPLYING FUEL TO AN ENGINE

(71) Applicant: Ford Global Technologies, LLC, Dearborn, MI (US)

(72) Inventors: Joseph Norman Ulrey, Dearborn, MI (US); Ross Dykstra Pursifull, Dearborn, MI (US); David Ord, Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 61 days.

(21) Appl. No.: 14/712,155

(22) Filed: May 14, 2015

(65) Prior Publication Data

US 2016/0333815 A1 Nov. 17, 2016

(51) Int. Cl.

| | |
|---|---|
| ***F02D 41/30*** | (2006.01) |
| ***F02D 41/38*** | (2006.01) |
| ***F02D 41/26*** | (2006.01) |
| *F02D 41/00* | (2006.01) |

(52) U.S. Cl.

CPC ..... *F02D 41/3082* (2013.01); *F02D 41/26* (2013.01); *F02D 41/3845* (2013.01); *F02D 41/0025* (2013.01); *F02D 2200/0602* (2013.01); *F02D 2200/0606* (2013.01); *F02D 2200/0612* (2013.01); *F02D 2200/0616* (2013.01)

(58) Field of Classification Search

CPC ..... F02D 41/22; F02D 41/2406; F02D 41/26; F02D 41/30; F02D 41/3082; F02D 41/38; F02D 41/3854; F02D 45/00; F02M 51/06; F02M 65/00

USPC ..... 701/103–105, 115; 123/445, 446, 447, 123/495, 502, 505

See application file for complete search history.

(56) References Cited

U.S. PATENT DOCUMENTS

| | | | | |
|---|---|---|---|---|
| 3,868,939 | A | 3/1975 | Friese et al. | |
| 4,080,942 | A | 3/1978 | Vincent et al. | |
| 4,083,340 | A | 4/1978 | Furr et al. | |
| 4,393,848 | A | 7/1983 | Poehlman | |
| 4,644,748 | A * | 2/1987 | Goss, Jr. | F16H 61/47 60/395 |
| 4,665,881 | A | 5/1987 | Wade | |

(Continued)

FOREIGN PATENT DOCUMENTS

| | | | |
|---|---|---|---|
| GB | 2310458 | A1 | 8/1997 |
| JP | 361175251 | A | 8/1986 |
| WO | 2007116303 | A1 | 10/2007 |

OTHER PUBLICATIONS

Ulrey, J. et al., "Fuel Delivery System and Method for Operation of a Fuel Delivery System," U.S. Appl. No. 14/577,093, filed Dec. 19, 2014, 26 pages.

(Continued)

*Primary Examiner* — John Kwon
*Assistant Examiner* — Johnny H Hoang
(74) *Attorney, Agent, or Firm* — Julia Voutyras; McCoy Russell LLP

(57) ABSTRACT

An engine system and method for adjusting pressure of fuel supplied to an engine responsive to compressibility of fuel supplied to the engine is disclosed. In one example, the engine is operated with a fuel pump in an off state to determine compressibility of fuel supplied to the engine. Fuel pressure supplied to the engine is adjusted responsive to the fuel compressibility.

18 Claims, 4 Drawing Sheets

(56) References Cited

U.S. PATENT DOCUMENTS

| | | | | |
|---|---|---|---|---|
| 5,054,458 | A | 10/1991 | Wechem et al. | |
| 5,159,915 | A | 11/1992 | Saito et al. | |
| 5,182,942 | A | 2/1993 | Hartel et al. | |
| 5,460,330 | A | 10/1995 | Steeb et al. | |
| 5,687,696 | A | 11/1997 | Takagi et al. | |
| 5,842,454 | A | 12/1998 | Miwa et al. | |
| 5,878,718 | A | 3/1999 | Rembold et al. | |
| 5,975,056 | A * | 11/1999 | Augustin | F02D 41/3809 123/300 |
| 6,053,036 | A | 4/2000 | Uto et al. | |
| 6,192,864 | B1 | 2/2001 | Nishimura | |
| 6,227,094 | B1 | 5/2001 | Taylor et al. | |
| 6,325,051 | B1 | 12/2001 | Oomori et al. | |
| 6,345,609 | B1 * | 2/2002 | Djordjevic | F02M 63/0225 123/456 |
| 6,374,807 | B1 | 4/2002 | Atanasyan et al. | |
| 6,481,641 | B1 | 11/2002 | Mieney | |
| 6,539,921 | B1 | 4/2003 | Matsumura | |
| 6,705,296 | B2 | 3/2004 | Hortsmann et al. | |
| 6,708,761 | B2 | 3/2004 | George et al. | |
| 6,802,209 | B2 | 10/2004 | Joos et al. | |
| 6,814,058 | B2 | 11/2004 | Oono | |
| 7,013,720 | B2 | 3/2006 | Date | |
| 7,093,426 | B2 | 8/2006 | Ichihara et al. | |
| 7,272,485 | B2 | 9/2007 | Amano et al. | |
| 7,363,916 | B2 | 4/2008 | Eser et al. | |
| 7,426,919 | B2 | 9/2008 | Kano et al. | |
| 7,448,367 | B1 | 11/2008 | Reddy et al. | |
| 7,640,916 | B2 | 1/2010 | Ulrey et al. | |
| 7,681,558 | B2 | 3/2010 | Gale et al. | |
| 7,703,435 | B2 | 4/2010 | Surnilla et al. | |
| 8,151,771 | B2 | 4/2012 | Pursifull et al. | |
| 8,483,932 | B2 | 7/2013 | Pursifull | |
| 2002/0139111 | A1 | 10/2002 | Ueda et al. | |
| 2005/0061297 | A1 | 3/2005 | Oono | |
| 2007/0137609 | A1 | 6/2007 | Morse | |
| 2009/0090331 | A1 | 4/2009 | Pursifull | |
| 2009/0205409 | A1 * | 8/2009 | Ciavarini | G01N 30/34 73/61.56 |
| 2009/0299609 | A1 * | 12/2009 | Gokhale | F02D 35/023 701/105 |
| 2012/0203447 | A1 * | 8/2012 | Kammerstetter | F02D 41/22 701/104 |
| 2013/0304353 | A1 * | 11/2013 | Viereck | F02D 41/12 701/102 |
| 2014/0230794 | A1 | 8/2014 | Surnilla et al. | |

OTHER PUBLICATIONS

Woodring, C. et al., "Fuel Delivery System with a Parallel Port Pressure Relief Valve," U.S. Appl. No. 12/119,650, filed Dec. 19, 2014, 28 pages.

Surnilla, G. et al, "Robust Direct Injection Fuel Pump System,"U.S. Appl. No. 14/155,250, filed Jan. 14, 2014, 61 pages.

Pursifull, R. "Fuel Rail Pressure Relief," SAE Technical Paper Series No. 2006-01-0626, Visteon Corporation, 11 pages.

De Cesare, M. et al., "Electric Low Pressure Fuel Pump Control for Fuel Saving," SAE Technical Paper Series No. 2013-1-0339, Magneti Marelli SpA Powertrain Division, Apr. 8, 2013, 11 pages.

* cited by examiner

METHOD AND SYSTEM FOR SUPPLYING FUEL TO AN ENGINE

BACKGROUND/SUMMARY

Port fuel injected engines receive fuel pumped from a fuel tank via a fuel pump. The fuel pump supplies fuel to a fuel rail, and fuel injectors coupled to the fuel rail inject fuel into engine intake ports. Fuel may be delivered to the engine from the fuel rail as liquid, gas, or a mixture of gas and liquid depending on a state of the fuel in the fuel rail. However, injecting fuel in a liquid state may be more desirable since the amount of fuel injected may be more easily controlled. Injection of liquid fuel may be ensured by increasing fuel pressure above the fuel's vapor pressure. The fuel pressure may be increased by supplying additional energy to the fuel pump. However, increasing the amount of energy supplied to the fuel pump may decrease vehicle fuel economy since energy to operate the fuel pump is derived from an alternator that is coupled to the vehicle's engine. Additionally, a pressure at which fuel may be delivered to the engine in a liquid state may vary with fuel composition and fuel temperature. Consequently, it may be difficult to provide fuel to an engine in a liquid state without delivering it at a pressure that increases vehicle fuel consumption more than is desired.

The inventors herein have recognized the above-mentioned limitations and have developed a method for fueling an engine, comprising: receiving fuel data to a controller; estimating fuel compressibility from the fuel data via instructions in the controller; and adjusting output of a fuel pump via the controller in response to the estimated fuel compressibility.

By adjusting output of a fuel pump responsive to fuel compressibility, it may be possible to provide the technical result of supplying liquid fuel to an engine while reducing power supplied to a fuel pump. In particular, the fuel's compressibility may provide a basis for regulating fuel pressure supplied to the engine so that liquid fuel may be provided to the engine while minimizing fuel pump energy consumption. Fuel pump output may be increased or decreased responsive to the fuel's compressibility. Consequently, even when fuel properties that affect state of a fuel being injected are unknown, fuel may be injected to the engine in a liquid state while minimizing fuel pump energy consumption.

The present description may provide several advantages. In particular, the approach may provide for supplying liquid fuel to an engine at reduced fuel pump outlet pressures. The reduced pressure is particularly useful for extending the injector's dynamic range to being able to accurately accommodate small fuel injection masses. The small fuel injection mass is important at idle conditions with fuel vapor purge operating. This action does not reduce the ability to provide standard pressure (or higher pressure) at high engine speed when the injection window is short. High engine speed is a less frequent condition, and therefore, high pressure during this condition does not substantially affect fuel economy. In addition, the method provides for adjusting fuel pressure supplied to an engine without knowledge of fuel type or fuel vapor pressure. Further, the approach provides for controlling energy supplied to a fuel pump without knowledge of fuel vapor pressure or fuel temperature.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
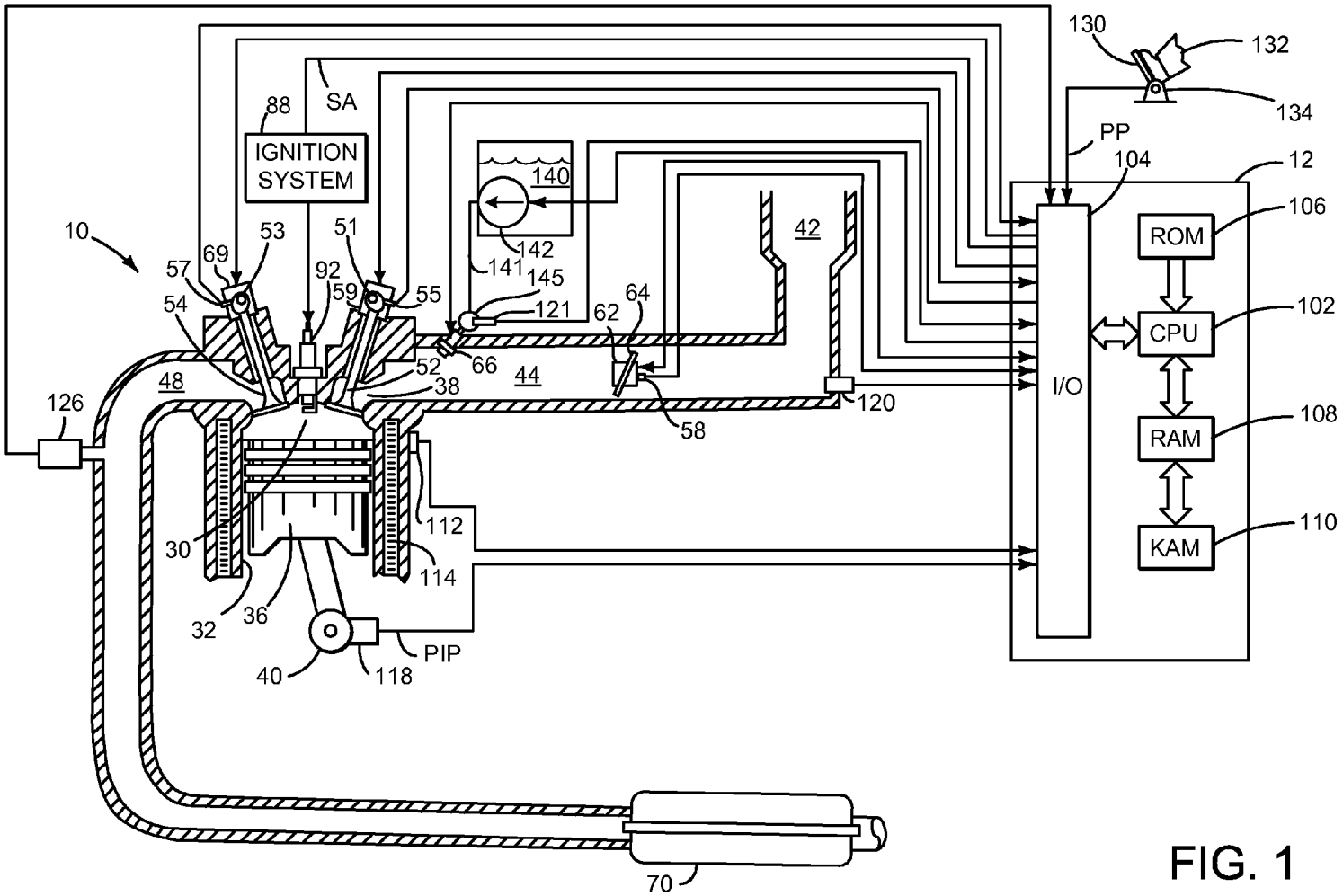
FIG. 1 shows a schematic depiction of an engine.
Figure 2:
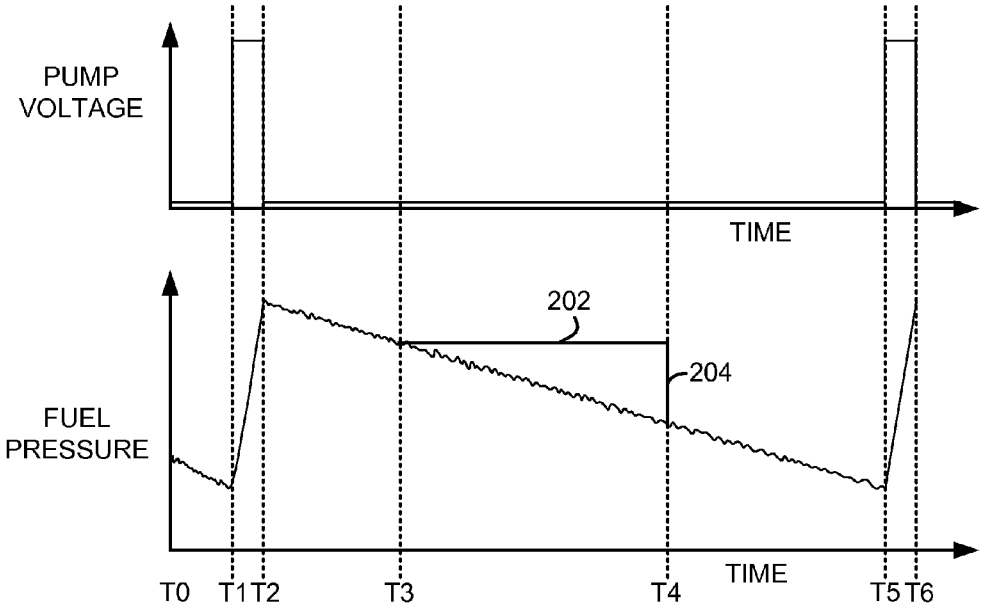
FIG. 2 shows a plot of an example way of determining fuel compressibility.
Figure 3:
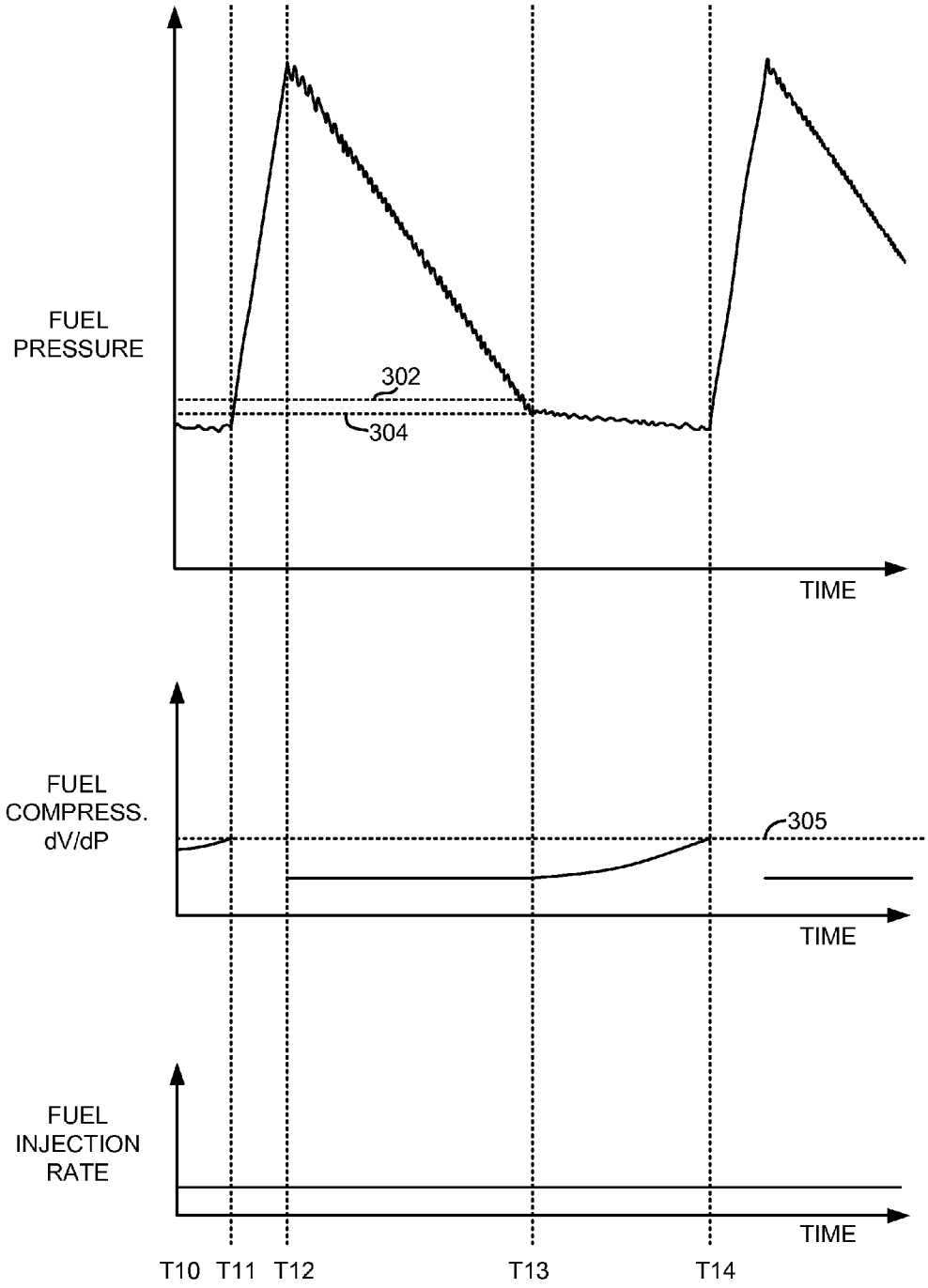
FIG. 3 shows a plot of an example way of determining a desired fuel pressure responsive to fuel compressibility.
Figure 4:
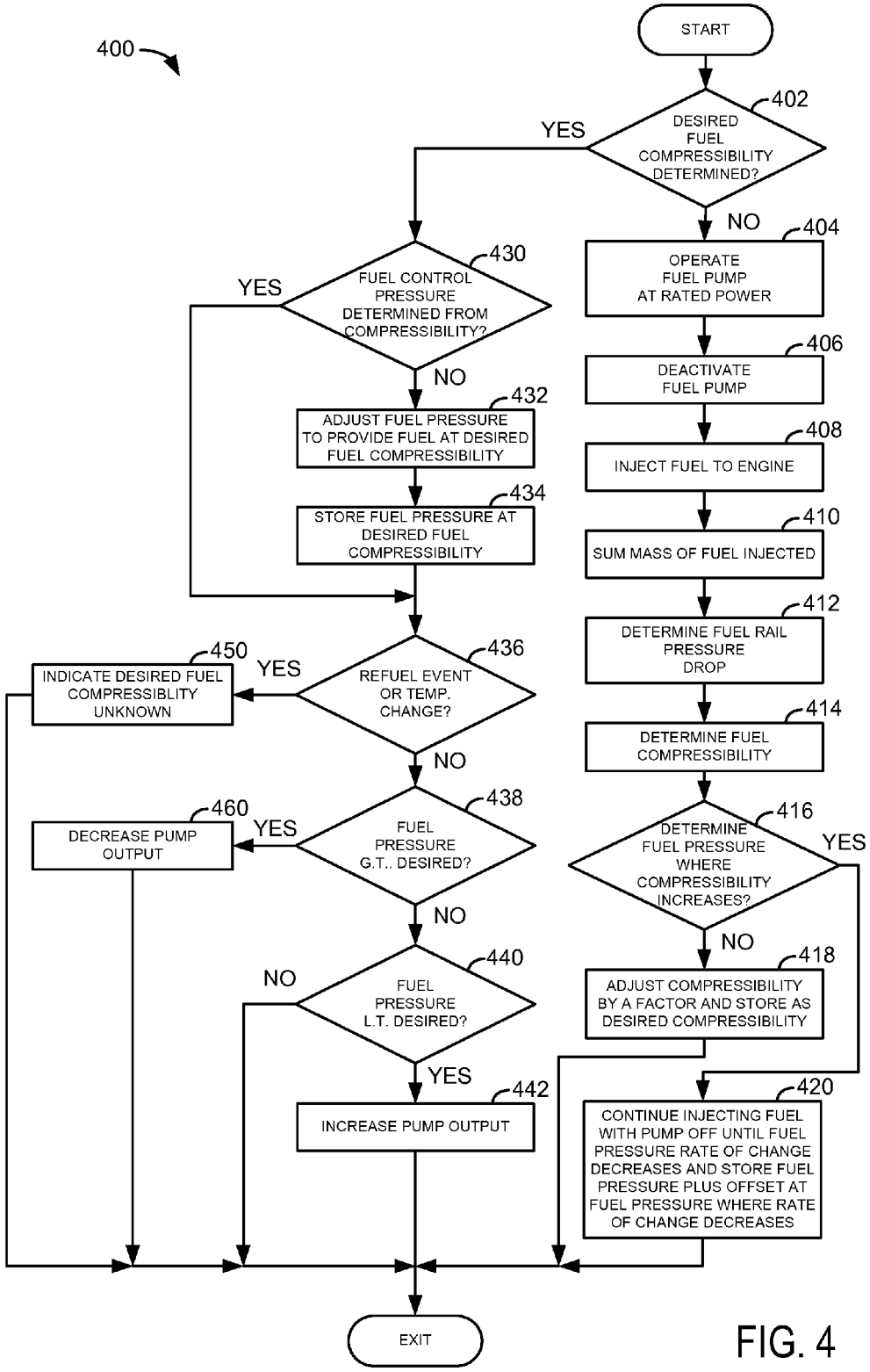
FIG. 4 shows a flowchart of an example method for supplying fuel to an engine.

The present description is related to supplying fuel to an engine such that liquid fuel is injected to the engine while reducing fuel pump energy consumption. In one example, fuel is supplied to an engine via a fuel system as is illustrated in FIG. 1. Compressibility of a fuel may be determined as is shown in FIG. 2 for adjusting output of a fuel pump. A desired fuel pump output pressure may be determined via determining a fuel pump pressure where fuel compressibility increases as is shown in FIG. 3. A method for adjusting output of a fuel pump responsive to fuel compressibility is shown in FIG. 4.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Alternatively, one or more of the intake and exhaust valves may be operated by an electromechanically controlled valve coil and armature assembly. The phase of intake cam 51 and exhaust cam 53 relative to crankshaft 40 may be adjusted via cam phase actuators 59 and 69. The position of intake cam 51 may be determined by intake cam sensor 55. The position of exhaust cam 53 may be determined by exhaust cam sensor 57.

Fuel injector 66 is shown positioned to inject fuel into port 38 of cylinder 30, which is known to those skilled in the art as port injection. Fuel injector 66 delivers liquid fuel in proportion to a pulse width from controller 12. Fuel is delivered to fuel injector 66 by a fuel system including a fuel tank 140, fuel pump 142, fuel line 141, and fuel rail 145. Fuel injector 66 and fuel pump 142 are supplied operating current from controller 12. In addition, intake manifold 44 is shown communicating with optional electronic throttle 62 which adjusts a position of throttle plate 64 to control air flow from air inlet 42.

Distributorless ignition system 88 provides an ignition spark to combustion chamber 30 via spark plug 92 in response to controller 12. Ignition system 88 may provide a single or multiple sparks to each cylinder during each cylinder cycle. Further, the timing of spark provided via ignition system 88 may be advanced or retarded relative to crankshaft timing in response to engine operating conditions.

Universal Exhaust Gas Oxygen (UEGO) sensor 126 is shown coupled to exhaust manifold 48 upstream of exhaust gas after treatment device 70. Alternatively, a two-state exhaust gas oxygen sensor may be substituted for UEGO sensor 126. In some examples, exhaust gas after treatment device 70 is a particulate filter and/or a three-way catalyst. In other examples, exhaust gas after treatment device 70 is solely a three-way catalyst.

Controller 12 is shown in FIG. 1 as a conventional microcomputer including: microprocessor unit 102, input/output ports 104, read-only memory 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator position adjusted by foot 132; fuel pressure from fuel pressure sensor 121; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

In some examples, the engine may be coupled to an electric motor/battery system in a hybrid vehicle. The hybrid vehicle may have a parallel configuration, series configuration, or variation or combinations thereof. Further, in some examples, other engine configurations may be employed, for example a diesel engine.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g., when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g., when combustion chamber 30 is at its smallest volume) is typically referred to by those of skill in the art as top dead center (TDC). In a process hereinafter referred to as injection, fuel is introduced into the combustion chamber. In a process hereinafter referred to as ignition, the injected fuel is ignited by known ignition means such as spark plug 92, resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is described merely as an example, and that intake and exhaust valve opening and/or closing timings may vary, such as to provide positive or negative valve overlap, late intake valve closing, or various other examples.

Thus, the system of FIG. 1 provides for a system for controlling an engine, comprising: an engine; a fuel pump supplying fuel to the engine; a controller including executable instructions stored in non-transitory memory for adjusting output of the fuel pump responsive to compressibility of fuel supplied to the engine. The system includes where compressibility of fuel supplied to the engine is based on a mass of fuel injected divided by a change in fuel rail pressure. The system further comprises a fuel rail coupled to the engine and a fuel injector, and a pressure sensor coupled to the fuel rail.

In some examples, the system further comprises additional instructions to estimate the compressibility of fuel supplied to the engine based on output of the pressure sensor. The system further comprises additional instructions to determine a desired fuel pressure in response to the compressibility of fuel supplied to the engine. The system further comprising additional instructions for estimating the compressibility of fuel supplied to the engine responsive to a change in fuel temperature or a refill of a fuel tank.

Referring now to FIG. 2, a simulated example plot of a way of determining fuel compressibility is shown. The sequence shown in the plot of FIG. 2 may be provided by the method of FIG. 4. Vertical markers T0-T6 represent times of interest during the sequence.

The first plot from the top of FIG. 2 represents voltage supplied to a fuel pump. The vertical axis represents fuel pump voltage and fuel pump voltage increases in the direction of the vertical axis arrow. The horizontal axis represents X axis represents time and time increases from the left side of FIG. 2 to the right side of FIG. 2.

The second plot from the top of FIG. 2 represents fuel pressure in a fuel rail supplying fuel to one or more engine cylinders. The vertical axis represents fuel rail fuel pressure and fuel pressure increases in the direction of the vertical axis arrow. The horizontal axis represents X axis represents time and time increases from the left side of FIG. 2 to the right side of FIG. 2. Fuel is injected to the engine at a same rate during the entire sequence shown in FIG. 2.

At time T0, the fuel pump is being commanded off as indicated by the low fuel pump voltage and fuel pressure in the fuel rail is decreasing. The fuel pressure in the fuel rail is decreasing in response to fuel being injected to engine cylinders to operate the engine.

At time T1, the fuel pump is activated as indicated by the higher fuel pump voltage. The fuel pump is activated in response to a request to determine the compressibility of fuel being injected to the engine. The fuel pressure in the fuel rail increases in response to activating the fuel pump.

At time T2, the fuel pump is deactivated as indicated by the transition from a higher fuel pump voltage to a lower fuel pump voltage. The fuel pump is deactivated to determine compressibility of fuel being injected to the engine. Fuel is injected to engine cylinders (not shown) even after the fuel pump is shut off and stops supplying fuel to the fuel rail.

Between time T2 and time T3, fuel is injected to the operating engine and the fuel pressure begins to decline since the fuel pump is not operating and replenishing fuel in the fuel rail. The fuel pressure declines at a constant rate since a constant rate of fuel is injected to the engine. If this same graph were plotted as fuel pressure versus fuel volume consumed, the pressure would drop in a line regardless of fuel rate as long as the fuel compressibility remained constant. Thus this computation can be performed even at varying fuel injection rate.

At time T3, an accumulated amount of fuel injected to the engine begins to be counted. The mass (or volume) of fuel injected to the engine may be determined based on an amount of time a fuel injector opens to inject fuel and a transfer function that provides a fuel amount versus fuel pressure and time the injector is open. Additionally, fuel pressure is determined so that fuel pressure drop in the fuel rail may be determined. Sampling the fuel pressure at multiples or sub-multiples of injection frequency may reduce the noise of the compressibility (d/dt V/d/dt P). A lot of volume change for little pressure change indicates high compressibility. Theoretically, if the fluid is at the vapor pressure, it has infinite compressibility. Also theoretically, if the fuel storage container was perfectly rigid and that fluid was entirely liquid, the compressibility is directly proportional to the reciprocal of bulk modulus.

At time T4, an accumulated amount of fuel injected to the engine stops being counted and the fuel rail pressure is determined. The total actual mass (or volume) of fuel injected to the engine is divided by the fuel rail pressure difference between time T3 and time T4 to determine compressibility of fuel injected to the engine. The fuel pressure drop is indicated by label 204. The amount of time fuel mass injected to the engine is accumulated is indicated by label 202.

Between time T4 and time T5, fuel continues to be injected to the engine while the fuel pump is off.

At time T5, the fuel pump is activated as indicated by the higher fuel pump voltage. The fuel pump is activated in response to a request to resupply fuel to the fuel rail. The fuel pressure in the fuel rail increases in response to activating the fuel pump.

At time T6, the fuel pump is deactivated as indicated by the transition from a higher fuel pump voltage to a lower fuel pump voltage. The fuel pump is deactivated to reduce fuel pump work after fuel pressure in the fuel rail reaches a desired value. Fuel continues to be injected to engine cylinders.

In this way, compressibility of fuel supplied to an engine may be determined while an engine is operating and a vehicle is driving down a road. Further, if the engine is operating at light loads, fuel compressibility may be determined frequently without interfering with engine operation since the engine is supplied smaller amounts of fuel during low engine load conditions.

Referring now to FIG. 3, a simulated sequence for determining a desired fuel pressure responsive to fuel compressibility is shown. The sequence of FIG. 3 may be provided by the method of FIG. 4 executed via instructions of controller 12 in the system of FIG. 1. Vertical markers T10-T14 represent times of interest during the sequence. Fuel is injected to the engine at a same rate during the entire sequence shown in FIG. 3. The three plots of FIG. 3 are time aligned and occur at a same time.

The first plot from the top of FIG. 3 represents fuel pressure in a fuel rail supplying fuel to an engine versus time. The vertical axis represents fuel pressure and fuel pressure increases in the direction of the vertical axis arrow. The horizontal axis represents time and time increases from the left side of FIG. 3 to the right side of FIG. 3.

The second plot from the top of FIG. 3 represents compressibility of fuel in the fuel rail supplying fuel to an engine versus time. The vertical axis represents compressibility of fuel in the fuel rail and compressibility increases in the direction of the vertical axis arrow. The horizontal axis represents time and time increases from the left side of FIG. 3 to the right side of FIG. 3. Horizontal line 305 represents a fuel compressibility threshold. It is desired to operate the fuel pump to keep fuel compressibility below threshold 305.

The third plot from the top of FIG. 3 represents fuel injection rate (e.g., cc/second) versus time. The vertical axis represents fuel injection rate and fuel injection rate increases in the direction of the vertical axis arrow. The horizontal axis represents time and time increases from the left side of FIG. 3 to the right side of FIG. 3.

At time T10, fuel pressure in the fuel rail is at a lower level. Fuel is being injected to the engine during the sequence but is not shown. The fuel pump is also deactivated (not shown). Fuel compressibility is increasing and the fuel injection rate is a constant rate.

At time T11, the fuel pump is activated responsive to fuel compressibility reaching threshold 305 and fuel pressure in the fuel rail increases in response to the fuel pump being activated. The fuel pump is activated to ensure fuel in the fuel rail is in a liquid state and not a partially gaseous (vapor) state. Compressibility is not calculated between time T11 and time T12 when the fuel pump is activated.

At time T12, the fuel pump is deactivated. The fuel pump may be deactivated at a predetermined time after it was activated or in response to fuel rail pressure reaching a desired pressure. Fuel continues to be injected to the engine at a constant rate after the fuel pump is deactivated (not shown) and fuel compressibility is determined to be at a lower value.

Between time T12 and time T13, fuel pressure in the fuel rail decreases as fuel is injected to the engine (not shown). In some examples, the fuel's compressibility may be determined between time T12 and time T13 as is described in FIG. 2. In this example, the fuel compressibility remains nearly constant and the fuel injection rate remains constant.

At time T13, the rate of change in fuel pressure (e.g., the slope) in the fuel rail decreases. The rate of change in fuel pressure decreases as the fuel vapor pressure floor is reached and fuel compressibility begins to increase. A portion of fuel in the fuel rail may be in a gaseous state. Horizontal line 304 represents a fuel rail pressure where the fuel rail pressure slope or rate of decline is reduced in response to the fuel vapor pressure floor being encountered. It may be desirable to operate with a pressure in the fuel rail indicated by horizontal line 302. Horizontal line 302 is equal to the fuel rail pressure of horizontal line 304 plus an offset. In this example, the offset is the pressure between horizontal line 304 and horizontal line 302. Thus, the fuel pump may be controlled to hold fuel pressure in the fuel rail at the level shown at horizontal line 302 to deliver liquid fuel to the engine and reduce energy supplied to the fuel pump. The fuel pump energy may be reduced when fuel rail pressure is at the level indicated by horizontal line 302 because operating the fuel rail at pressures higher than the level of line 302 increases fuel pump energy consumption. The fuel pressure offset between horizontal line 304 and horizontal line 302 provides a confidence interval that fuel in the fuel rail does not enter a gaseous state. The fuel injection rate remains constant.

Between time T13 and time T14, fuel continues to be injected to the engine with the fuel pump off. Pressure in the fuel rail decreases at a slower rate or a lower slope as compared to between time T12 and time T13 even though fuel is injected to the engine at a same rate. However, fuel compressibility increases steadily, even as the fuel injection rate remains constant.

At time T14, the fuel pump is reactivated to increase fuel pressure in the fuel rail in response to fuel compressibility reaching threshold 305. The fuel injection rate remains constant and the calculation of fuel compressibility ceases. The sequence may be repeated several times to confirm a pressure in the fuel rail where the fuel's vapor pressure floor is reached.

In this way, a control pressure for adjusting fuel pump output may be determined. The control pressure is a pressure that provides liquid fuel to the engine while supplying a lower amount of energy to a fuel pump supplying fuel to the fuel rail and the engine. Alternatively, a voltage, duty cycle, current, or power may be associated with measured pressure, and voltage, duty cycle, current, or power would be the controller's new set point, after a margin is added.

Referring now to FIG. 4, a flowchart of an example method for supplying fuel to an engine is shown. At least a portion of the method of FIG. 4 may be incorporated into the system of FIG. 1 as executable instructions. Further, portions of the method of FIG. 4 may take place in the physical world via a controller receiving data from sensors and controlling actuators. The method of FIG. 4 is active when an engine in a vehicle is operating. The fuel compressibility test may be prevented if the fuel injection rate is high. At high injection rates, we may choose to use an a priori pressure or lift pump electrical energy level.

At 402, method 400 judges if compressibility of fuel being injected to the engine has been determined. It may be desirable to determine a fuel's compressibility because the fuel's compressibility increases to a higher value when the fuel may be at least partially in a gaseous state. The fuel's compressibility is a lower value when the fuel is solely in a liquid state. In one example, a bit in memory may be set to a value of one when a fuel's compressibility is known and a value of zero when the fuel's compressibility is unknown. If method 400 judges that the fuel's compressibility is known, the answer is yes and method 400 proceeds to 430. Otherwise, the answer is no and method 400 proceeds to 404. The idea here is to drive the fuel pressure high enough where one knows a priori that the fuel pressure is well above the vapor pressure and to determine the compressibility at this condition. While we refer to the compressibility as a property of the fuel alone, it is actually also a property of the mechanical structure containing the fuel because the container itself is less than fully rigid.

At 404, a fuel pump supplying fuel to a fuel rail and engine is operated at full or rated power to provide a higher pressure in the fuel rail. The fuel pump may be activated for a predetermined amount of time or until a threshold pressure is reached within the engine's fuel rail. Method 400 proceeds to 406 after the fuel pump has been on the predetermined amount of time or until the threshold pressure in the fuel rail is reached.

At 406, method 400 deactivates the fuel pump. The fuel pump stops providing fuel to the fuel rail when the fuel pump is deactivated. The fuel pump may be deactivated by stopping flow of electrical power to the fuel pump. Method 400 proceeds to 408 after the fuel pump is deactivated.

At 408, method 400 injects fuel to the engine. Fuel is injected to the engine at a constant rate so that each cylinder receives substantially (e.g., within +5 percent) same amount of fuel. Method 400 proceeds to 410.

At 410, method 400 sums the mass (or volume) of fuel provided to the engine via the fuel rail. The fuel is injected over several engine cycles and pressure in the fuel rail decreases in response to not supplying fuel to the fuel rail via the fuel pump and injecting fuel to engine cylinders. The fuel mass (or volume) injected to engine cylinders may be summed for a predetermined amount of time or until a predetermined pressure drop in fuel rail pressure is observed. In one example, the mass (or volume) of fuel injected to engine cylinders may be determined via indexing a fuel injector transfer function that outputs a fuel mass given fuel rail pressure and time the fuel injector was open. Method 400 proceeds to 412.

At 412, method 400 determines a fuel rail pressure drop responsive to injection of fuel to an operating engine and a fuel pump being in an off state. The fuel rail pressure drop is determined from a time when summing of mass of fuel injected begins to a time when summing of mass of fuel injected ends. Method 400 proceeds to 414.

At 414, method 400 determines compressibility of fuel injected to the engine. The fuel's compressibility is determined by dividing the summed mass (or volume) of fuel injected as determined at 410 by the change in fuel rail fuel pressure determined at 412. Additionally, method 400 indicates fuel compressibility is known by setting a bit in memory to a value of one. FIG. 2 provides an example of the sequence described from 404 to 414. In some examples, the sequence from 404 may be repeated several times and an average fuel compressibility taken to determine the fuel's compressibility. Method 400 proceeds to 416 after fuel compressibility is determined.

At 416, method 400 judges if it is desired to determine a pressure of fuel in the fuel rail where fuel compressibility increases to indicate at least a portion of fuel in the fuel rail being in a gaseous state. It may be desirable to determine the pressure of fuel in the fuel rail where fuel compressibility increases to indicate the fuel's vapor pressure floor when the engine is operating at lower loads where the engine may be operated without large changes in engine torque or air-fuel ratio. Thus, if the engine is operating within a prescribed speed range and torque range, the pressure of fuel in the fuel rail where fuel compressibility increases may be determined. If method 400 judges that it is desired to determine a pressure of fuel in the fuel rail where fuel compressibility increases, the answer is yes and method 400 proceeds to 420. Otherwise, the answer is no and method 400 proceeds to 418.

At 420, method 400 continues to inject fuel to the engine with the fuel pump off to determine a desired fuel pressure to provide in the fuel rail via the fuel pump. Method 400 determines a slope or rate of change in fuel rail pressure versus mass of fuel injected. Fuel compressibility is low when fuel is in a liquid state and it is higher when in a gaseous or at least partially gaseous state. A change in slope or rate of change of fuel rail pressure with respect to mass of fuel injected from a higher value to a lower value may indicate a transition in a fuel's compressibility as is shown in FIG. 3. The engine may be operated at constant conditions (e.g., constant mass of fuel injected, constant speed, and constant torque) when the change in fuel pressure slope versus mass of fuel injected is determined. Fuel pressure at which the slope or rate of change in fuel pressure changes is determined as described in FIG. 3 and stored to memory. The fuel pressure in the fuel rail where the fuel pressure slope changes is indicative of a fuel vapor pressure floor. In one example, a predetermined offset value is added to the fuel pressure in the fuel rail where the fuel pressure slope changes to determine a desired pressure of fuel in the fuel rail to ensure injecting liquid fuel and reducing energy consumed via the fuel pump providing fuel to the fuel rail. This sequence is illustrated in FIG. 3. Method 400 proceeds to exit after the desired pressure of fuel in the fuel rail is determined. The desired pressure of fuel in the fuel rail may be a basis for controlling output of the fuel pump. Further, a value of a bit in memory may be changed to a value of one to indicate a fuel control pressure is determined.

At 418, method 400 adjusts the fuel compressibility value determined at 414 by a predetermined factor (e.g., 1.4). The resulting value is a desired fuel compressibility and the desired fuel compressibility may be the basis for controlling output of the fuel pump supplying fuel to the fuel rail. Method 400 proceeds to exit after the desired fuel compressibility is determined.

A next time method 400 is executed, the desired pressure of fuel in the fuel rail or the desired fuel compressibility may be a basis for controlling output of the fuel pump supplying fuel to the fuel rail and engine.

At 430, method 400 judges if a fuel control pressure for fuel in the fuel rail has been determined from compressibility of fuel in the fuel rail. In one example, if a value of a variable in memory is one, the answer is yes and method 400 proceeds to 436. Otherwise, the answer is no and method 400 proceeds to 432. The variable may be set to a value of one at 420.

At 432, method 400 adjusts fuel pressure to provide fuel in the fuel rail at a desired fuel compressibility value. The desired fuel compressibility value may come from 418. In one example, fuel pressure is adjusted to a maximum value and decreased in predetermined increments until the desired fuel compressibility value is provided. The fuel compressibility may be determined as described at 404-414 each time the pressure of fuel in the fuel rail is decreased incrementally to determine if fuel in the fuel rail has the desired compressibility. Method 400 proceeds to 434 after fuel pressure in the fuel rail is at a level that provides the desired compressibility.

At 434, method 400 stores to memory a fuel pressure of fuel in the fuel rail that provides the desired fuel compressibility. The stored fuel pressure value is a desired fuel pressure for controlling fuel pressure in the fuel rail. Method 400 proceeds to 436 after storing the desired fuel pressure to memory.

At 436, method 400 judges if a fuel tank refill has occurred or if a change in fuel temperature at the fuel rail has occurred. Method 400 may judge that a fuel refill has occurred if a fuel tank sensor indicates an increase in fuel stored in a fuel tank. Method 400 may judge a change in fuel temperature has occurred based on engine temperature or a measured temperature of fuel in the fuel rail. If method 400 judges that a fuel refill has occurred or that there is a change in fuel temperature at the fuel rail, the answer is yes and method 450 proceeds to 450. Otherwise, the answer is no and method 400 proceeds to 438.

At 450, method 400 indicates that the desired fuel compressibility is unknown so that a new fuel compressibility value may be determined at 404-414. Method 400 proceeds to exit after setting a value of a bit in memory to zero to indicate fuel compressibility is unknown.

At 438, method 400 judges if fuel pressure in the fuel rail is greater than (G.T.) the desired fuel pressure plus a predetermined offset value. If so, the answer is yes and method 400 proceeds to 460. Otherwise, the answer is no and method 400 proceeds to 440.

At 460, method 400 decreases fuel pump output via reducing voltage and/or current supplied to the fuel pump. The fuel pump output may be decreased proportionately with a difference between desired fuel pressure and actual fuel pressure. Method 400 proceeds to exit after fuel pressure is adjusted.

At 440, method 400 judges if fuel pressure in the fuel rail is less than (L.T.) the desired fuel pressure minus a predetermined offset value. If so, the answer is yes and method 400 proceeds to 442. Otherwise, the answer is no and method 400 proceeds to exit after making no fuel pump output adjustments.

At 442, method 400 increases fuel pump output via increasing voltage and/or current supplied to the fuel pump. The fuel pump output may be increased proportionately with a difference between desired fuel pressure and actual fuel pressure. Method 400 proceeds to exit after fuel pressure is adjusted.

In this way, fuel pressure in a fuel rail may be adjusted responsive to compressibility of fuel in a fuel rail being delivered to an engine. The fuel rail pressure is adjusted to provide liquid fuel to the engine while reducing fuel pump energy consumption.

Thus, the method of FIG. 4 provides for a method for fueling an engine, comprising: receiving fuel data to a controller; estimating fuel compressibility from the fuel data via instructions in the controller; and adjusting output of a fuel pump via the controller in response to the estimated fuel compressibility. The method includes where estimating fuel compressibility includes dividing a mass of fuel injected to the engine by a pressure drop in a fuel rail. The method also includes where the fuel data includes fuel pressure in a fuel rail. The method includes where the fuel data includes an estimate of mass of fuel injected.

In some examples, the method includes where adjusting output of the fuel pump includes increasing a voltage or an amount of current supplied to the fuel pump in response to the estimated fuel compressibility being greater than a threshold compressibility value. The method includes where adjusting output of the fuel pump includes decreasing a voltage or an amount of current supplied to the fuel pump in response to the estimated fuel compressibility being less than a threshold compressibility.

The method of FIG. 4 also provides for a method for fueling an engine, comprising: injecting fuel to an engine while a fuel pump that supplies fuel to the engine is stopped; receiving fuel data to a controller while the fuel pump is stopped; providing a desired fuel pressure responsive to a change in a slope of fuel pressure from the fuel data; and adjusting output of a fuel pump via the controller in response to the desired fuel pressure. The method includes where the change in slope is indicative of a fuel vapor pressure.

The method also includes where the desired fuel pressure is greater than a fuel pressure where the slope changes. In some examples, the method includes where the change in the slope is a decrease in slope. The method further comprises revising the desired fuel pressure in response to a change in fuel temperature or a refill of a fuel tank. The method includes where the fuel data received includes fuel pressure. The method includes where output of the fuel pump is adjusted to provide the desired fuel pressure. The method includes where injecting fuel to the engine while the fuel pump that supplies fuel to the engine is stopped is responsive to a change in fuel temperature or a fuel tank refill.

Note that the example control and estimation routines included herein can be used with various engine and/or vehicle system configurations. Further, the methods described herein may be a combination of actions taken by a controller in the physical world and instructions within the controller. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller This concludes the description. The reading of it by those skilled in the art would bring to mind many alterations and modifications without departing from the spirit and the scope of the description. For example, I3, I4, I5, V6, V8, V10, and V12 engines operating in natural gas, gasoline, diesel, or alternative fuel configurations could use the present description to advantage.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method for fueling an engine, comprising:

receiving fuel data to a controller;

estimating fuel compressibility from the fuel data via instructions in the controller; and adjusting output of a fuel pump via the controller in response to the estimated fuel compressibility, where adjusting output of the fuel pump includes increasing a voltage or an amount of current supplied to the fuel pump in response to the estimated fuel compressibility being greater than a threshold compressibility.

2. The method of claim 1, where estimating fuel compressibility includes dividing a mass of fuel injected to the engine by a pressure drop in a fuel rail.

3. The method of claim 1, where the fuel data includes fuel pressure in a fuel rail.

4. The method of claim 1, where the fuel data includes an estimate of mass of fuel injected.

5. The method of claim 1, further comprising adjusting output of the fuel pump via decreasing a voltage or an amount of current supplied to the fuel pump in response to the estimated fuel compressibility being less than a threshold compressibility.

6. A method for fueling an engine, comprising:

injecting fuel to an engine while a fuel pump that supplies fuel to the engine is stopped;

receiving fuel data to a controller while the fuel pump is stopped;

determining a change in fuel compressibility from a change in slope of pressure from the fuel data;

ensuring injection of liquid fuel to the engine via providing a desired fuel pressure, the desired fuel pressure a pressure above where the change in fuel compressibility occurs plus an offset pressure; and adjusting output of the fuel pump via the controller in response to the desired fuel pressure.

7. The method of claim 6, where the change in slope is indicative of at least a portion of fuel in a fuel rail being in a gaseous state.

8. The method of claim 7, where the desired fuel pressure is greater than a fuel pressure where the slope changes, and where the desired fuel pressure is provided in a fuel rail.

9. The method of claim 6, where the change in the slope is a decrease in slope.

10. The method of claim 6, further comprising revising the desired fuel pressure in response to a change in fuel temperature or a refill of a fuel tank.

11. The method of claim 6, where the fuel data received includes fuel pressure.

12. The method of claim 6, where output of the fuel pump is adjusted to provide the desired fuel pressure.

13. The method of claim 6, where injecting fuel to the engine while the fuel pump that supplies fuel to the engine is stopped is responsive to a change in fuel temperature or a fuel tank refill.

14. A system for controlling an engine, comprising:

an engine;

a fuel pump supplying fuel to the engine; and a controller including executable instructions stored in non-transitory memory for adjusting output of the fuel pump responsive to compressibility of fuel supplied to the engine, where compressibility of fuel supplied to the engine is based on a mass of fuel injected divided by a change in fuel rail pressure.

15. The system of claim 14, further comprising a fuel rail coupled to the engine and a fuel injector, and a pressure sensor coupled to the fuel rail.

16. The system of claim 15, further comprising additional instructions to estimate the compressibility of fuel supplied to the engine based on output of the pressure sensor.

17. The system of claim 14, further comprising additional instructions to determine a desired fuel pressure in response to the compressibility of fuel supplied to the engine.

18. The system of claim 17, further comprising additional instructions for estimating the compressibility of fuel supplied to the engine responsive to a change in fuel temperature or a refill of a fuel tank.

* * * * *